US006070505A

United States Patent [19]

Dzierzbicki

[11] Patent Number: 6,070,505

[45] Date of Patent: Jun. 6, 2000

[54] P-HANDLE EXTRACTION TOOL

[76] Inventor: Mark L. Dzierzbicki, 413 Cambridge Way, Bolingbrook, Ill. 60440

[21] Appl. No.: 09/010,221

[22] Filed: Jan. 21, 1998

[51] Int. Cl.[7] ..... B25B 23/00

[52] U.S. Cl. ..... 81/441; 81/35; 81/73

[58] Field of Search ..... 81/441, 177.1, 81/177.2, 177.5, 28, 35, 37, 489, 73

[56] References Cited

U.S. PATENT DOCUMENTS

| | | | |
|---|---|---|---|
| D. 335,071 | 4/1993 | Fine | D8/29 |
| 754,295 | 3/1904 | Foit | 81/35 |
| 847,596 | 3/1907 | McMurtry . | |
| 1,053,536 | 2/1913 | Sargent | 81/73 X |
| 1,714,361 | 5/1929 | Gougler | 81/35 |
| 1,863,045 | 6/1932 | Randall et al. | 81/441 |
| 2,493,398 | 1/1950 | Fricke | 81/124.1 |
| 3,157,074 | 11/1964 | Durkee | 81/73 X |
| 3,882,753 | 5/1975 | Svensen | 81/177 |
| 3,952,618 | 4/1976 | Seamon | 81/441 |
| 4,212,336 | 7/1980 | Smith | 81/436 |
| 4,325,276 | 4/1982 | Jordan | 81/441 |
| 4,437,365 | 3/1984 | Yaari | 81/177.1 X |
| 4,974,477 | 12/1990 | Anderson | 81/73 |
| 5,438,894 | 8/1995 | Pearce | 81/177.2 |
| 5,479,670 | 1/1996 | Coffey | 7/138 |
| 5,505,571 | 4/1996 | Jakob | 81/28 X |
| 5,511,445 | 4/1996 | Hildebrandt | 81/177.1 X |
| 5,579,558 | 12/1996 | Newman, Jr. et al. | 16/115 |

FOREIGN PATENT DOCUMENTS

| | | | |
|---|---|---|---|
| 1 175 261 | 10/1984 | Canada . | |
| 320472 | 10/1929 | United Kingdom | 81/441 |

*Primary Examiner*—D. S. Meislin

*Attorney, Agent, or Firm*—Marshall, O'Toole, Gerstein, Murray & Borun

[57] ABSTRACT

The present invention is directed to a P-handle extraction tool for removing and/or installing a tubular member when access to the external surface of the tubular member is restricted. The tool uses a P-shaped handle to orient the grip of the tool approximately perpendicular to the longitudinal axis of the tubular member to be removed or installed that is engaged by the tool. Thus oriented, the tubular member is rotated by rotating the grip about the axis of rotation of the tubular member. The handle design also provides for the attachment of a torque arm, thereby allowing the user to generate additional torque necessary to remove tightly fitted tubular members.

10 Claims, 2 Drawing Sheets

P-HANDLE EXTRACTION TOOL

FIELD OF THE INVENTION

The present invention relates generally to the installation of tubular objects and, more specifically, to a P-handle extraction tool for the removal and/or installation of threaded tubular objects.

DESCRIPTION OF THE RELATED ART

Many applications utilize threaded tubular members to connect one part to another part thereby allowing fluid flow between the parts. One such application occurs in in-ground sprinkler systems wherein a tubular member, commonly referred to as a nipple, is used to connect a sprinkler head to a water line. The nipple has external threads on either end, with the threads on one end being screwed into the water line and the threads on the opposite end being screwed into the sprinkler head.

Generally, a tubular member such as the nipple may be screwed in using a pipe wrench or other tool that engages the external surface of the tube. Unfortunately, in many applications, the tubular member is surrounded by other components of the system that restrict access to the external surface of the tubular member, thereby preventing use of the pipe wrench to remove or install the tubular member. For example, in the sprinkler system described above, the nipple and the sprinkler head are recessed within an outer casing that protects the sprinkler head assembly when the assembly is installed in the ground. After the sprinkler assembly is installed, the only access to the nipple is through the open end of the casing and, therefore, a nipple cannot be installed or removed using a pipe wrench. Moreover, once installed, the sprinkler head assembly is buried in the ground. If maintenance is require, the entire sprinkler head assembly must be dug out of the ground in order to remove the tubular member.

In order to remove or install a tubular member disposed in an area with restricted access, a tool must have an end adapted to be inserted into the open end of the tubular member and engage the inner surface of the member such that a torque may be applied in the direction of the desired rotation of the member without slippage. One type of tool previously used to install and remove tubular members like the sprinkler nipple includes a T-shaped handle with a shank or shaft extending therefrom and a tapered end. The handle, shank and tapered end are integrally formed as a single piece of metal. The tapered end includes four to six external ribs that run from the end of the tip toward the handle and are generally parallel to a longitudinal axis of the tool.

To install or remove a tubular member, the tapered end of the T-handle tool is inserted into the open end of the tubular member until the external ribs engage the inner surface of the tubular member. Once the tapered end is installed, the installer grasps the handle and applies a torque in the direction of the desired rotation. The tubular member will rotate in the desired direction if the frictional or engagement force applied by the ribs on the inner surface is greater than the frictional force between the meshing threads of the tubular member and the member to which the tubular member is coupled.

The previous T-handle tool may work adequately on PVC or phenolic tubing, or on metal tubing having non-circular bores, but the tool is ineffective on metal tubing with circular bores. The external ribs of the tool do not engage the inner surface of the metal tubing with sufficient frictional force to overcome the friction between the meshing threads.

Therefore, the installer cannot tighten the tubular member sufficiently to prevent the fluid from leaking through the meshing threads. Additionally, the fixed-length shank of the T-handle tool is too short to be used in all applications. Moreover, the maximum torque that can be exerted on the tubular member is that which is generated by the strength in the installer's wrist. If the frictional force required to loosen a tubular member is sufficient to overcome the torque exerted by the installer's wrist, then the installer may be required to remove other components surrounding the tubular member, or dig out a buried assembly, in order to access the external surface of the tubular member.

Therefore, there is a need for an improved extraction/installation tool for tubular members that provides a reliable grip on tubular members fabricated from different materials and having differing bore geometries, is versatile enough for use in a wide variety of applications, facilitates quick and easy installation and removal of tubular members, and provides a mechanical advantage allowing the installer to apply a sufficient torque to remove tightly installed tubular members.

SUMMARY OF THE INVENTION

The present invention is directed to a P-handle extraction tool for removing and/or installing a tubular member when access to the external surface of the tubular member is restricted. The tool uses a P-shaped handle to orient the single grip of the tool approximately perpendicular to the longitudinal axis of the tubular member to be removed or installed that is engaged by the tool. Thus oriented, the tubular member is rotated by rotating the grip about the axis of rotation of the tubular member. The handle design also provides for use in combination with an extension allowing the user to generate additional torque necessary to remove tightly fitted tubular members.

According to one aspect of the present invention, a hand tool includes a single grip having a grip portion, a grip longitudinal axis and a longitudinal center, and a shaft having one end connected to one end of the grip portion. The hand tool further includes a coupling portion having a coupling longitudinal axis and one end connected to the end of the shaft opposite the grip portion. Connected in this way, the coupling longitudinal axis of the coupling portion is approximately perpendicular to the grip longitudinal axis of the grip portion and intersects the grip portion at approximately its longitudinal center.

The hand tool may further include an attachment member demountably attached to the coupling portion at the end opposite the shaft. In one embodiment, the attachment member may be a socket having a coupling end adapted to be demountably attached to the coupling portion, and a tapered end opposite the coupling end. The tapered end of the socket may further include a plurality of helical grooves disposed on the exterior thereof.

The hand tool may further include an extension having an extension longitudinal axis that is adapted to be demountably coupled to the grip portion at the end opposite the shaft. When coupled to the grip, the extension longitudinal axis is approximately parallel to the grip longitudinal axis. Additionally, the curved shaft of the hand tool may include a straight portion, a first curve connecting the straight portion to the grip portion, and a second curve connecting the straight portion to the coupling portion. In a preferred embodiment, the first curve of the shaft is approximately 180° and the second curve of the shaft is approximately 90°. Moreover, the socket may be demountably coupled to the coupling portion using a quick release coupling mechanism that is well known in the art. In one embodiment, the end of the coupling portion coupled to the socket has an end portion having a detent member on the exterior thereof, and the socket has an aperture adapted to receive the end portion and having an inner surface adapted to engage the detent member to demountably couple the socket to the coupling portion.

According to another aspect of the present invention, a hand tool is provided for use in installing and removing a tubular member having a bore and an open end. The hand tool includes only a single grip having a grip portion, a grip longitudinal axis and a longitudinal center, and a shaft having one end connected to one end of the grip portion. The hand tool further includes a coupling portion having a coupling longitudinal axis and one end connected to the end of the shaft opposite the grip portion. Connected in this way, the coupling longitudinal axis of the coupling portion is approximately perpendicular to the grip longitudinal axis of the grip portion and intersects the grip portion at approximately its longitudinal center The hand tool may further include an attachment member demountably attached to the coupling portion at the end opposite the shaft. In one embodiment, the attachment member may be a socket having a coupling end adapted to be demountably attached to the coupling portion, and a tapered end opposite the coupling end. The tapered end of the socket may further include a plurality of helical grooves disposed on the exterior thereof and adapted to frictionally engage the bore of the tubular member when the tapered end of the socket is inserted into the open end of the tubular member.

The features and advantages of the invention will be apparent to those of ordinary skill in the art in view of the detailed description of the preferred embodiment, which is made with reference to the drawings, a brief description of which is provided below.

DETAILED DESCRIPTION OF THE PREFERRED EMBODIMENTS

Figure 1:
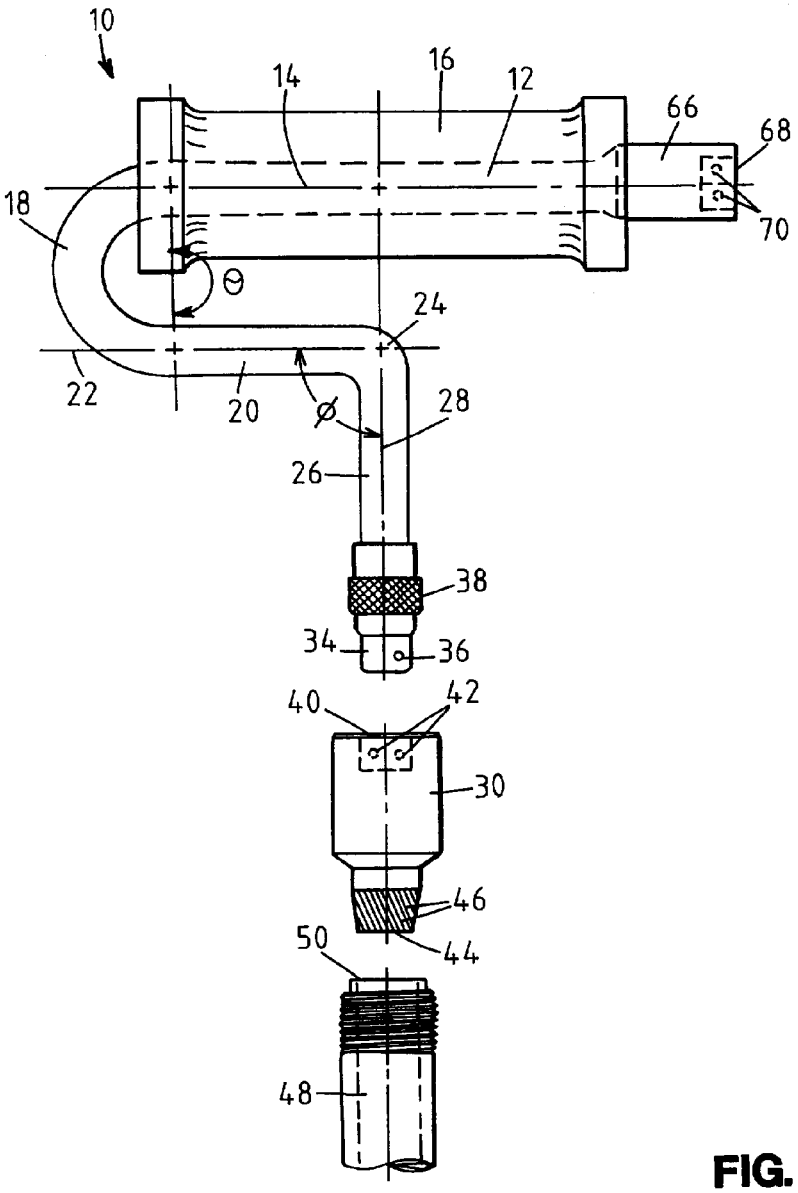
FIG. 1 is an exploded front view of a P-handle extraction tool according to the present invention.

A P-handle extraction tool 10 for use in installing and removing tubular objects is illustrated in FIG. 1, which is an exploded front view. The P-handle extraction tool 10 has a single grip 12 at one end with a first longitudinal axis 14 and having either a knurled surface or a sleeve 16 fabricated from a resilient, spongy material disposed thereon. The tool 10 further includes a first curve 18 at an angle θ to the first longitudinal axis 14 at one end of the grip 12. The first curve 18 connects the grip 12 to an intermediate portion 20 of the tool 10 having a second longitudinal axis 22. The angle θ of the first curve 18, as shown in FIG. 1, is approximately 180° so that the second longitudinal axis 22 is approximately parallel to the first longitudinal axis 14. A second curve 24 at an angle ϕ to the second longitudinal axis 22 is located at the end of the intermediate portion 20 opposite the first curve 18 and connects the intermediate portion 20 to a coupling portion 26 of the tool 10. The angle ϕ of the second curve 24, shown as approximately 90° in FIG. 1, is dimensioned so that a third longitudinal axis 28 of the coupling portion 26 is approximately perpendicular to the first longitudinal axis 14 of the grip 12. Additionally, the intermediate portion 20 has a length dimensioned such that the third longitudinal axis 28, if extended beyond the end of the coupling portion 26 and through the grip 12, would intersect the grip 12 at approximately its 20 longitudinal center.

The tool 10 illustrated in FIG. 1 has a first curve 18 having an angle θ of approximately 180° and a second curve having an angle ϕ of approximately 90° such that the third longitudinal axis 28 is approximately perpendicular to the first longitudinal axis 14 and disposed at approximately the longitudinal center of the grip 12. However, other combinations of angles θ and ϕ and lengths of the intermediate portion 20 that will achieve the desired relative orientation of the longitudinal axes 14, 28 will be obvious to those of ordinary skill in the art and are contemplated by the inventor as having use with the P-handle extraction tool according to the present invention. For example, the angle θ could be less than 180° and the angle θ could be greater than 90° such that the longitudinal axes 14, 28 are perpendicular and the intermediate portion 20 is not parallel to the longitudinal axis 14. Moreover, the first curve 18 could be formed by a pair of curves connected by a relatively straight portion such that the longitudinal axes 14, 22 are parallel. In either configuration, and in other configurations that will be obvious to those of ordinary skill in the art, the longitudinal axis 28 is properly oriented approximately perpendicular to the longitudinal axis 14 to form a P-handle extraction tool according to the present invention.

The coupling portion 26 includes the male portion of a quick release coupling mechanism disposed at the end opposite the second curve 24. The male portion of the coupling mechanism will mate with a corresponding female portion of an attachment, such as a socket 30 or and extension member 32, such as the one shown in FIG. 2. Referring to FIG. 1, the male portion of the coupling mechanism includes a tip 34 at the end of the coupling portion 26 having a detent ball 36 protruding through and extending beyond the outer surface of the tip 34. The ball 36 is biased outwardly by a mechanism (not shown) within the coupling portion 26. A knurled sleeve 38 is slidable on the outside of the coupling portion 26 and controls the biasing mechanism for the ball 36. When the knurled sleeve 38 is slid toward the grip 12, the biasing mechanism releases the ball 36, thereby releasing the coupling mechanism.

The socket 30 is adapted to be coupled to the coupling portion 26 of the tool 10 at one end and to engage a tubular member 30 at the other end. At the coupling end, the socket 30 includes a female portion of the coupling mechanism. The female portion includes an aperture 40 having an inner surface adapted to receive the tip 34. The aperture 40 further includes one or more recesses 42 for receiving and engaging the ball 36 when the tip 34 is inserted into the aperture 40, thereby locking the socket 30 on the coupling portion 26. The socket 30 is released by sliding the knurled sleeve 38 toward the grip 12 to unlock the ball 36. Although the coupling mechanism shown herein is similar to the type used in a socket wrench, other quick release coupling mechanisms will be obvious to those of ordinary skill in the art and are contemplated by the inventor as having use with the P-handle extraction tool 10 according to the present invention. At the end of the socket 30 opposite the aperture 40, the socket 30 includes a tapered end 44 having a plurality of helical grooves 46 spaced evenly around the outer surface of the tapered end 44.

In use, the P-handle extraction tool 10 is used to install and/or remove a tubular member 48, such as a sprinkler head nipple. The socket 30 is attached to the coupling portion 26 via the coupling mechanism described above. The tapered end 44 of the socket 30 is inserted into an open end 50 of the tubular member 48 until the tapered end 44 engages the inner surface of the bore of the tubular member 48. The grooves 46 on the tapered end 44 frictionally engage the inner surface of the tubular member 48 so that the tubular member 48 rotates with the tool as the installer rotates the grip 12 about the third longitudinal axis 28 of the coupling portion 26. When resetting his/her hand for the next rotation of the tool 10, the installer releases the grip 12, repositions his/her hand, and regrasps the grip 12 without interference from the other components of the tool 10. The tool 10 can be used with virtually any tubular member 30 because the grooves 46 will frictionally engage inner surfaces of tubular members 30 having varying bore geometries, such as circular, square and hexagonal, and will frictionally engage tubular members 30 fabricated from different materials, such as metal pipe and PVC and phenolic tubing.

Figure 2:
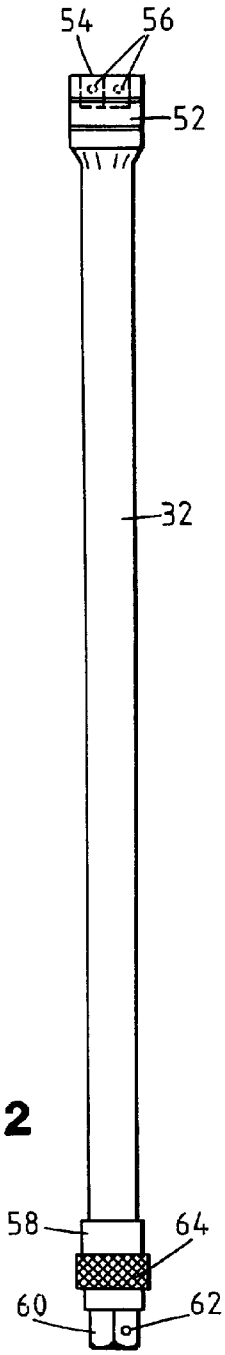
FIG. 2 is a front view of an extension member for the P-handle extraction tool of FIG. 1.
Figure 3:
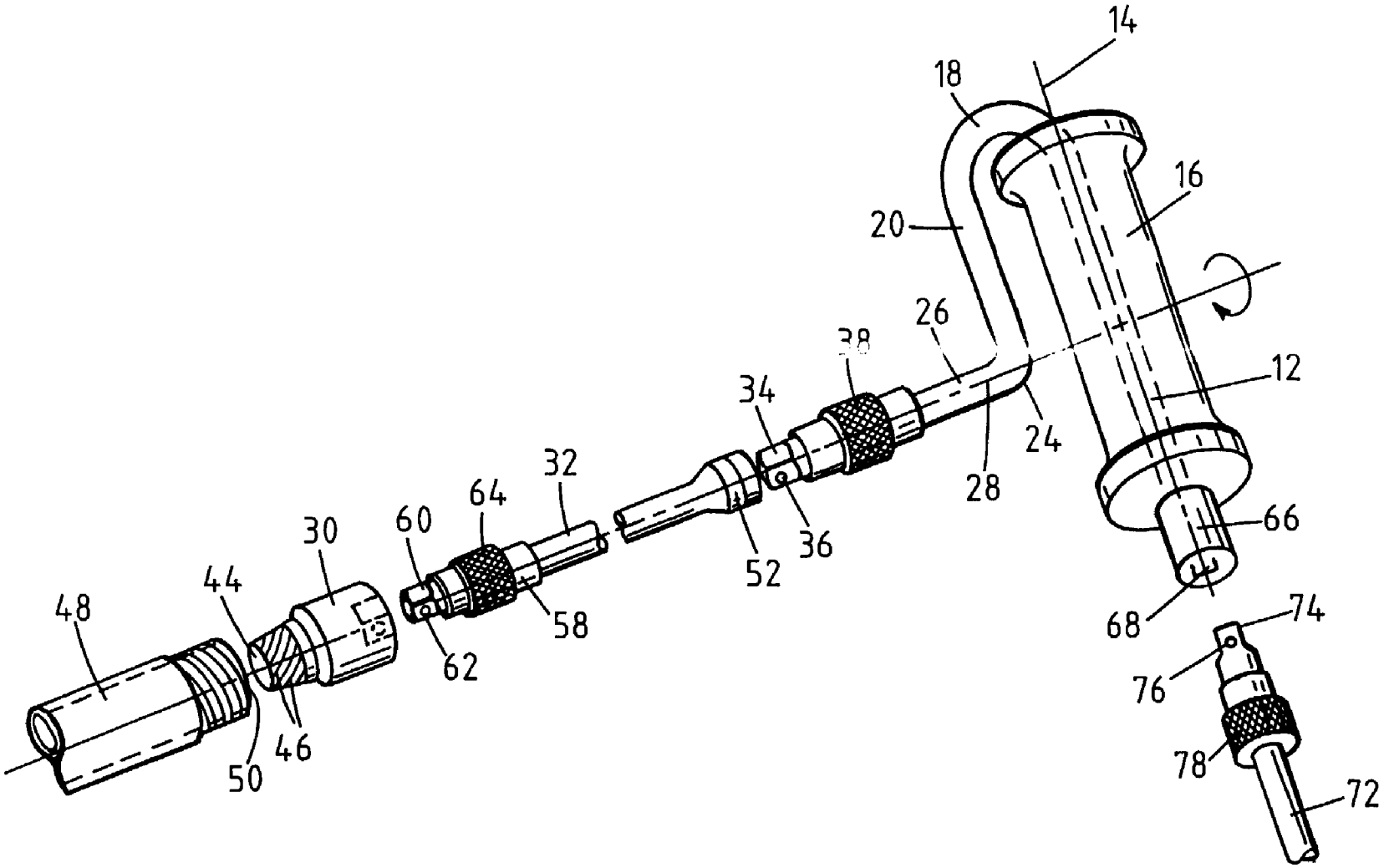
FIG. 3 is an exploded perspective view of the P-handle extraction tool of FIG. 1.

The P-handle extraction tool 10 may further include an extension member 32, such as the one shown in FIG. 2, in order to reach tubular members 30 that are too isolated to be reached by the coupling portion 26. The extension member 32 includes a female end 52, similar to the coupling end of the socket 30, that includes an aperture 54 having one or more recesses 56 for engaging the ball 36 on the tip 34. The extension member 32 further includes a male end 58 opposite the female end 52 similar to the male portion on the coupling member 26 and including a tip 60, detent ball 62 and a knurled sleeve 64. The extension member 32 couples the socket 30 to the coupling portion 26 in a similar manner as the socket 30 couples directly to the coupling portion 26, as shown in FIG. 3. The tip 16 is inserted into the aperture 54 of the extension member 32 and the ball 36 is engaged by one of the recesses 56 to lock the extension member 32 in place on the coupling portion 26. The tip 60 at the male end 58 of extension member 32 is inserted into the aperture 40 of the socket 30 and the ball 62 is engaged by one of the recesses 42 to lock the socket in place on the extension member 32.

In some situations, the strength in the installer's wrist is not sufficient to generate enough torque to loosen the tubular member 48. To enable the installer to generate additional torque, the tool can be used in combination with moment arm. As shown in FIG. 1, the tool 10 further includes a female coupling end 66 extending from the end of the grip 12 opposite the first curve 18 and having an aperture 68 and one or more recesses 70, as previously described. The female coupling end 66 is adapted to receive a moment arm 72 (FIG. 3) having male portion of a quick release coupling mechanism including a tip 74, detent ball 76 and a knurled sleeve 78. The moment arm 72 is coupled to the female coupling end 66 in the same manner as previously discussed. When the moment arm 72 is coupled to the grip 12, the installer can grasp the grip 12 with one hand while using the other hand to exert a force on the moment arm 72, thereby creating a greater torque on the tubular member 30 than is possible using only the installer's wrist strength.

The P-handle extraction tool is primarily intended for use in the installation and maintenance of in-ground sprinkler systems. However, the tool may also have utility in other areas such as automotive repair and plumbing. Additionally, the tool may also be provided with sockets having tapered ends with different diameters and different geometries to facilitate use of the tool with tubular members with different bore diameters and/or geometries. Also, the handle portion of the P-handle extraction tool may be used as to drive virtually any attachment adapted to be coupled by a quick-release coupling mechanism, such as a crow's foot adapter, a socket wrench, a screw driver and the like. Moreover, in an alternative embodiment for use in applications with a need for one particular tool, the handle and the attachment, such as a socket, of the P-handle extraction tool are integrally formed as a single unitary tool.

While the present invention has been described with reference to the specific examples, which are intended to be illustrative only and not to be limiting of the invention, it will be apparent to those of ordinary skill in the art that changes, additions, and/or deletion may be made to the disclosed embodiment without departing from the spirit and scope of the invention.

What is claimed is:

1. A hand tool for single-handed operation and having a rotational axis, the hand tool comprising:

only a single grip having an elongated grip portion, opposed grip ends, a grip longitudinal axis and a grip longitudinal center;

a coupling portion having opposed coupling ends and a coupling longitudinal axis coincident with the rotational axis; and a shaft connecting one of the grip ends to one of the coupling ends;

wherein the coupling longitudinal axis is approximately perpendicular to the grip longitudinal axis and intersects the grip portion at approximately the longitudinal center.

2. A hand tool according to claim 1, further comprising an attachment member adapted to be demountably coupled to the coupling portion at the coupling end opposite the shaft.

3. A hand tool according to claim 2, wherein the attachment member comprises a socket having a socket end adapted to be demountably coupled to the coupling portion, and a tapered end opposite the coupling end having a plurality of helical grooves disposed on the exterior thereof.

4. A hand tool according to claim 2, wherein the coupling end coupled to the attachment member comprises a male member having a detent member on the exterior thereof, and the attachment member has an aperture adapted to receive the male member and having an inner surface adapted to engage the detent member to demountably couple the attachment member to the coupling portion.

5. A hand tool according to claim 1, further comprising a tapered end portion coupled to the coupling end opposite the shaft, wherein the grip portion, the shaft, the coupling portion and the tapered end portion are integrally formed from a single piece of material.

6. A hand tool according to claim 1, wherein the curved shaft further comprises:

a straight portion;

a first curve connecting the straight portion to the grip end and a second curve connecting the straight portion to the coupling end.

7. A hand tool according to claim 6, wherein the first curve is approximately 180° and the second curve is approximately 90°.

8. A hand tool according to claim 1, further comprising a sleeve fabricated from a resilient, spongy material and disposed on the grip portion.

9. A hand tool for single-handed operation and having a rotational axis, the hand tool comprising:

only a single grip having an elongated grip portion, opposed grip ends, a grip longitudinal axis and a grip longitudinal center;

a coupling portion having opposed coupling ends and a coupling longitudinal axis coincident with the rotational axis, wherein the coupling longitudinal axis is approximately perpendicular to the grip longitudinal axis and intersects the grip portion at approximately the grip longitudinal center;

a shaft connecting one of the grip ends to one of the coupling ends; and a tapered end portion coupled to the coupling end opposite the shaft and having a plurality of helical grooves disposed on the exterior thereof.

10. A hand tool according to claim 9, wherein the grip portion, curved shaft, coupling portion and tapered end portion are integrally formed from a single piece of material.

* * * * *